United States Patent [19]

Plante

[11] Patent Number: 4,703,706

[45] Date of Patent: Nov. 3, 1987

[54] ELASTIC BAND FEEDING AND TENSIONING MECHANISM FOR A SEWING MACHINE

[76] Inventor: Denis Plante, 998 Dupas, Longueuil, Quebec, Canada, J4L 2Z5

[21] Appl. No.: 15,627

[22] Filed: Feb. 17, 1987

[51] Int. Cl.[4] ..... D05B 21/00; D05B 37/04; D05B 3/22

[52] U.S. Cl. ..... 112/265.1; 112/121.26; 112/130; 112/104; 112/113; 112/305; 112/262.1; 112/152

[58] Field of Search ..... 112/121.26, 121.27, 112/121.15, 130, 129, 104, 113, 265.1, 262.1, 152

[56] References Cited

U.S. PATENT DOCUMENTS

| | | | |
|---|---|---|---|
| 3,792,672 | 2/1974 | Friedman et al. | 112/121.26 |
| 4,024,824 | 5/1977 | Haff, Jr. | 112/130 X |
| 4,067,273 | 1/1978 | Manjorio | 112/152 X |
| 4,132,184 | 1/1979 | Burton | 112/262.1 X |
| 4,147,120 | 4/1979 | Adamski et al. | 112/121.26 X |
| 4,182,248 | 1/1980 | Klages | 112/121.26 |
| 4,590,874 | 5/1986 | Baclagis | 112/121.26 |

*Primary Examiner*—H. Hampton Hunter

[57] ABSTRACT

An elastic band feeding and tensioning mechanism and method for the application of an elastic band, having at least a portion thereof tensioned, on a fabric piece fed under a stitching needle of a sewing machine. A footplate guide is provided for positioning the elastic band in alignment on a fabric piece. A sewing guide member is adapted for securement to a foot arm of a sewing machine, and has a jaw opening for receiving the elastic band. A guide mechanism is provided for guiding the elastic band toward the jaw opening. The elastic band is advanced through the sewing machine by the feeddog of the sewing machine and tension is applied to the band by tension members. The tension members comprise a drive and idler rolls driven at a band feeding speed slower than the feeddog, and a further band stretching roll which instantaneously stitches the band between the drive roll and feeddog. A control circuit activates the tension members whereby to feed a predetermined length of the elastic band in a predetermined stretched condition through the sewing guide member for sewing the stretched elastic band on the fabric piece. A cutting element also cuts the elastic band at a predetermined location.

39 Claims, 16 Drawing Figures

Fig. 15
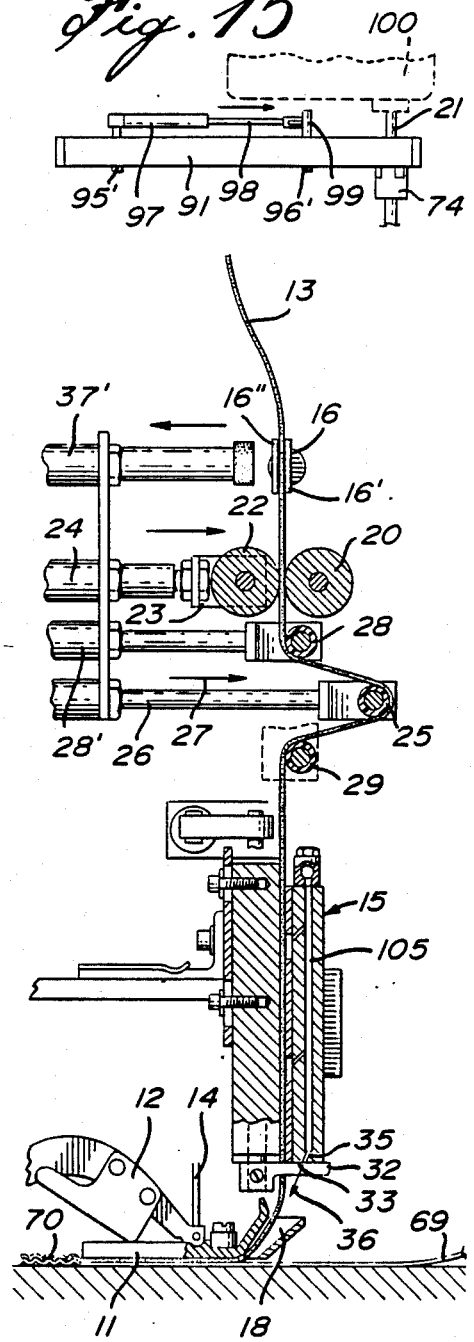
Fig. 3
Fig. 16
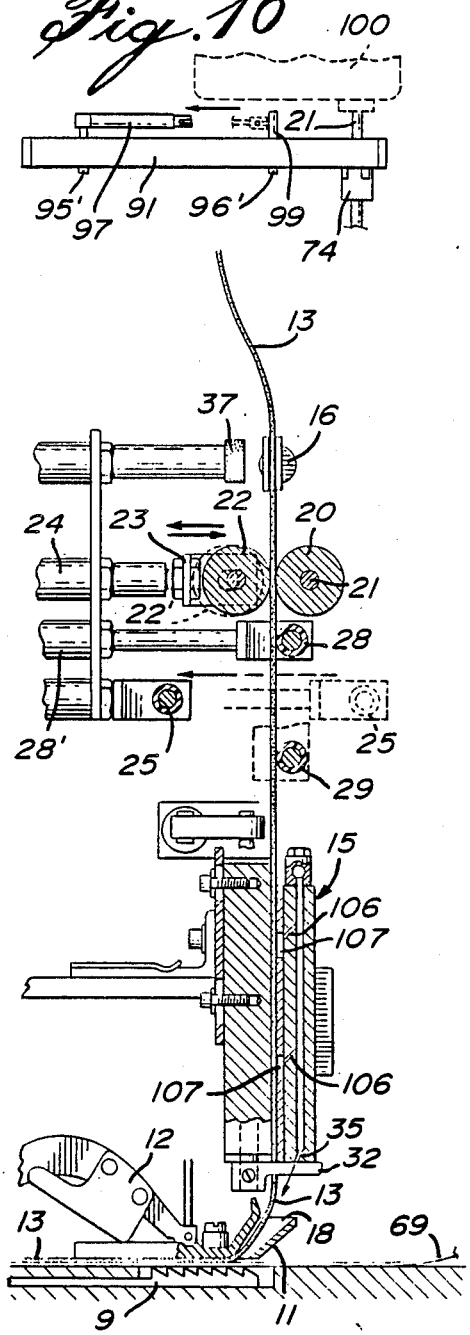
Fig. 2

90
97'
97
100
98
110
99
21
93
95'
96'
67
74
66
68"
68
68'
63'
21
17'
20
16
37'
15
63'
17
16'
16'''
16''
81
37
65
64

Fig. 13
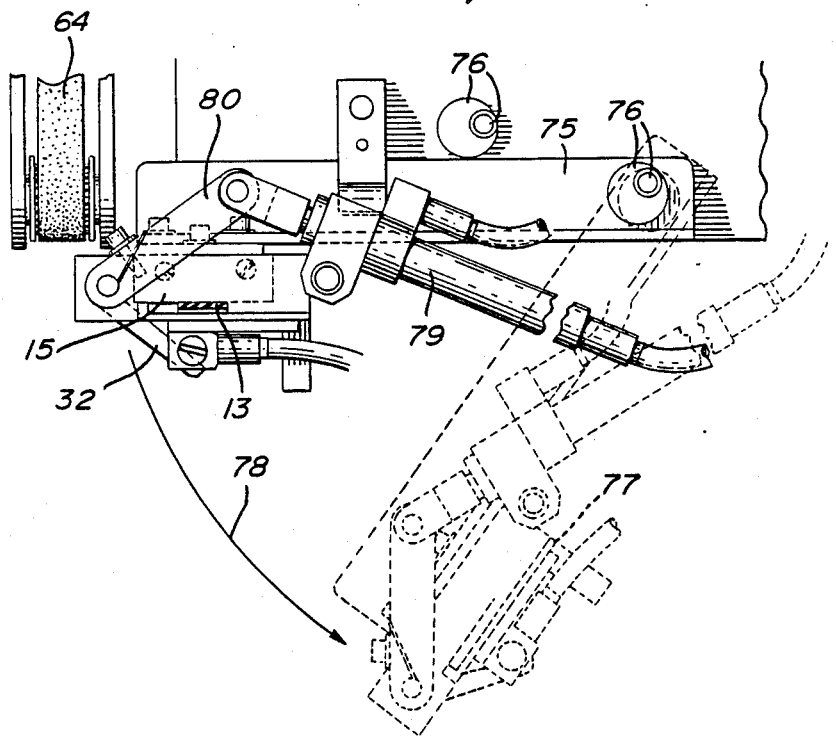
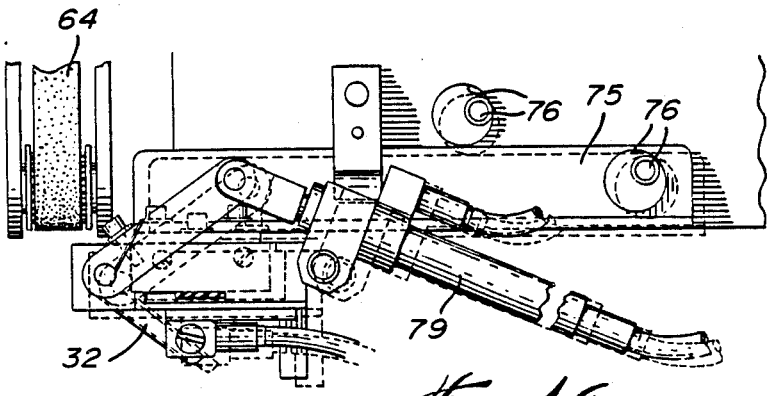
Fig. 14

ELASTIC BAND FEEDING AND TENSIONING MECHANISM FOR A SEWING MACHINE

BACKGROUND OF INVENTION

1. Field of the Invention

The present invention relates to an elastic feeding and tensioning mechanism and method for feeding to the stitching needle of a sewing machine at least a stretched portion of the elastic band whereby to produce a gathered fabric with the gathers being formed by releasing the tension in the band after the band is stitched to the fabric piece.

2. Description of Prior Art

It is known to provide gathers in fabrics by gathering the fabric and stitching the gathered fabric over an elastic band. This requires a special feeddog assembly and guide having a feeddog capable of gathering material prior to the sewing of same. Also, the complexity of the feeddog assembly results in many malfunctions and machine down time. Further, such machines are solely designed and constructed to effect an elastic band application function and the sewing machine cannot be used for other work which requires ordinary stitching. A still further disadvantage of known prior art machines is that they do not produce a quality product, are expensive to fabricate, and are not adaptable to existing sewing machines.

SUMMARY OF INVENTION

It is a feature of the present invention to provide an elastic band feeding and tensioning mechanism for use with a sewing machine, preferably but not exclusively of the overlock stitching type, and which substantially overcomes all of the above-mentioned disadvantages of the prior art.

Another feature of the present invention is to provide an elastic band feeding and tensioning mechanism which is adaptable to existing sewing machines and wherein the mechanism is pivotally connected to be engaged or disengaged whereby to permit ordinary use of the sewing machine.

Another feature of the present invention is to provide an elastic band feeding and tensioning mechanism wherein the elastic band is instantaneously tensioned and sewn under tension whereby to automatically gather the fabric on which it is sewn when the tension is released after sewing the band to the fabric.

Another feature of the present invention is to provide an elastic band feeding and tensioning mechanism which is economical, easy to use, and which provides a high quality application of an elastic band on a piece of fabric.

Another feature of the present invention is to provide an elastic band feeding and tensioning mechanism which permits the sewing of at least two tensioned elastic bands side by side on a fabric piece, alternately, whilst maintaining accurate guide and uniform gathering of the fabric.

Another feature of the present invention is to provide a novel method of feeding and tensioning at least a portion of an elastic band for application on a fabric piece fed under a stitching needle of a sewing machine.

According to the above features, from a broad aspect, the present invention provides an elastic band feeding and tensioning mechanism for use with a sewing machine. The mechanism comprises a footplate guide for positioning an elatic band in alignment on a fabric piece.

A sewing guide member is adapted for securement to a foot arm of a sewing machine and having a jaw opening for receiving the elastic band. Guide means is provided for for guiding the elastic band toward the jaw opening. Drive means advances the elastic band through the guide means. Tensioning means is provided for stretching the elastic band, said tension means including a tension drive roll and drive idler engageable with said tension drive roll for feeding said elastic band at a predetermined speed slower than said drive means, and a band stretching means for instantaneously stretching said elastic band between said tension drive roll and said drive means, and cutting means to cut said elongated flat band in an area prior to entering said jaw opening of said sewing guide member. Cutting means is also provided to cut the elastic band prior to entry into the jaw opening of the sewing guide member.

According to another broad aspect of the present invention, there is provided storage means for storing a predetermined length of the elastic band in an unstretched condition after the cutting means has been activated.

According to a still further broad aspect of the present invention there is provided an elastic band feeding and tensioning mechanism having feed means for feeding a free end portion of the elastic band in the jaw opening of the sewing guide member.

According to another broad aspect of the present invention there is provided a method of feeding and tensioning at least a portion of an elastic band for application on a fabric piece fed under a stitching needle of a sewing machine. The method comprises the steps of feeding the elastic band in a sewing guide member for positioning the band over a fabric piece and under a sewing needle of a sewing machine. The elastic band is pulled by the feeddog of the sewing machine. The stretching of the elastic band is obtained by tensioning means which engage the band and feed same at a rate slower than the pulling rate of the feeddog to stretch the band. The band is also instantaneously stretched intermediate the feeddog and the tensioning means to apply a predetermined tension to the band immediately when the tensioning means is actuated. The band is then severed at a predetermined location.

BRIEF DESCRIPTION OF DRAWINGS:

A preferred embodiment of the present invention will now be described with reference to the example thereof as illustrated in the accompanying drawings, in which:

FIGS. 2, 3 and 4 are simplified sectioned side views showing the main feeding and tensioning mechanism of the present invention;

FIGS. 13 and 14 are top views showing the pivotal support frame of the band feeding and tensioning mechansim which is securable to a sewing machine; and FIGS. 15 and 16 are schematic top views illustrating the connection of the speed control device to a speed control box to provide the controllable drive speed of the mechanism.

DESCRIPTION OF PREFERRED EMBODIMENTS

Figure 1:
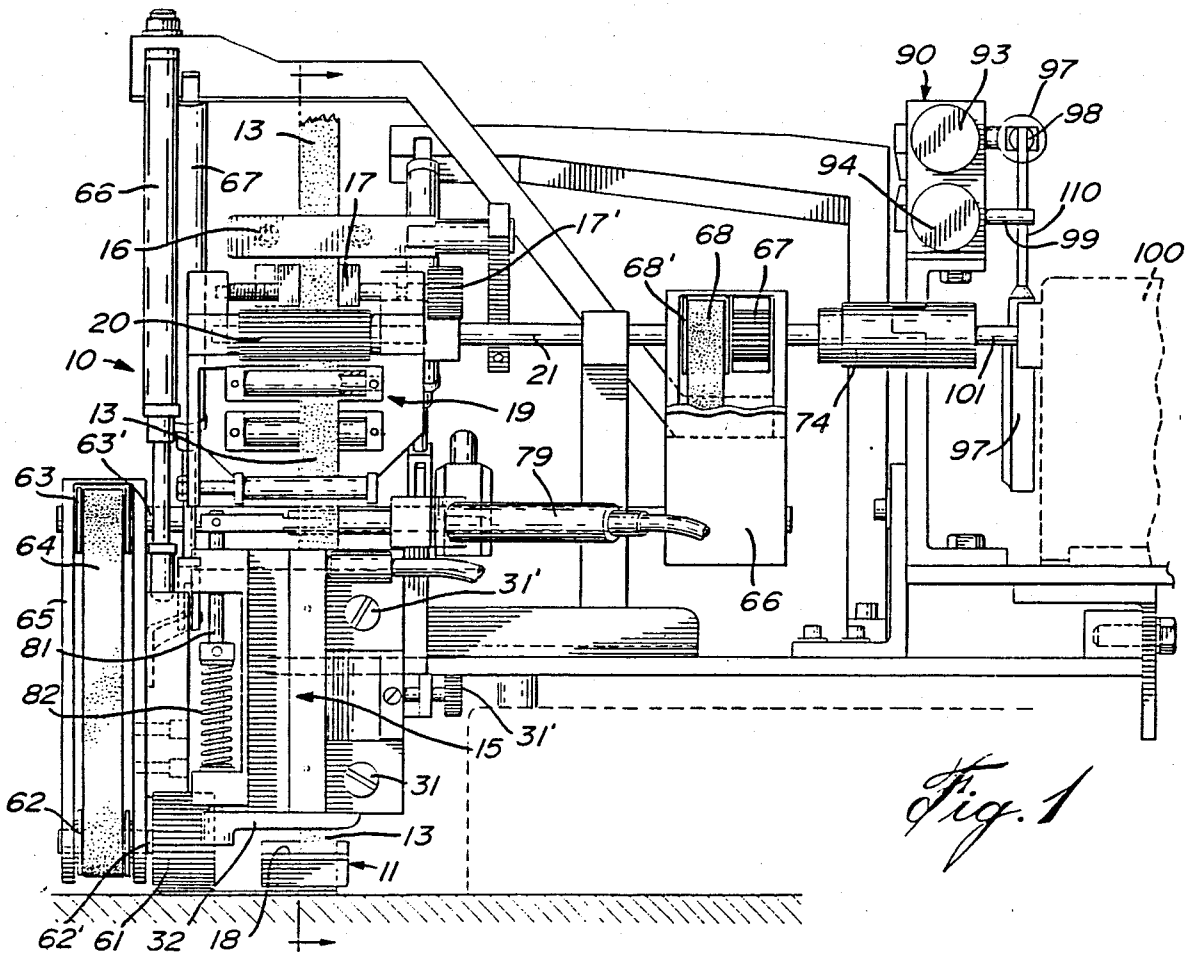
FIG. 1 is a front view of the elastic band feeding and tensioning mechanism of the present invention.

Referring now to the drawings, and more particularly to FIG. 1, there is shown generally at 10 the construction of the elastic band feeding and tensioning mechanism for use with a sewing machine (not shown). Generally, the mechanism comprises a sewing guide member 11 which is securable to a foot arm 12 of the sewing machine. The sewing guide member 11 positions the elastic band 13 in a guided manner under the stitching needle 14 of the sewing machine. Guide means, in the form of a guide tunnel device 15, as well as tension guide jaws 16 guide the elastic band into the jaw opening 18 of the sewing guide member 11. The alignment of the elastic band 11 is adjusted by a transversely adjustable guide member 17. The elastic band 13 is advanced through the guide tunnel 15 by the feeddog 9 of the sewing machine and tension means 20–25 are provided to apply to the band.

Referring now additionally to FIGS. 2 to 5, there is better illustrated the operation of the elastic band feeding and tensioning mechanism 10 of the present invention. As herein shown the band 13 is fed to the machine from a supply bin or roll (not shown) and fed through the tension guide jaws 16 to provide friction sliding fit with the elastic band to apply a slight tension thereto.

The guide jaws 16 comprise a stationary plate 16' and a spring bias plate 16'' having two coil springs 16''' bias there against to apply limited friction engagement with the band 13. The tension in the springs 16''' is adjustable.

The band 13 then passes adjacent the adjustable guide member 17 whose position is adjustable by knob 17'. The band 13 then passes through a pair of rolls which consist of a drive roll 20 which is connected to a drive shaft 21, and a drive idler roll 22 which is displaceably positionable toward the drive roll 20 to clamp the elastic band 13 therebetween. This drive roll 20 is driven at a speed inferior to the stitching speed of the sewing needle 14 and pulling speed of the feeddog 9 which pulls the elastic band to stretch the band which is held between the rolls 20–22. When the drive idler roll 22, which is connected to the displaceable support frame 23, is pulled away from the drive roll 20 by its piston 24, the drive roll is disengaged from the elastic band 13. This is done during the non-stretching cycle of the mechanism as will be described later. Accordingly, the drive means of the present invention is constituted by the feeddog 9, and the drive roll 20 which pulls the band from its supply bin or roll through the tension guide jaws 16 constitutes an adjustable stretching means. The stretching of the elastic band is controlled by the speed of rotation of the drive wheel 20 which will be described later.

The tension means further includes a band stretching idler roll 25 which is also secured to a piston rod 26 and displaceable transversely to the long axis of the elastic band 13 to stretch the band in the area between the drive roll and the footplate guide. The length of the piston stroke or advancement of the piston rod 26 in the direction of arrow 27 is controlled by a pair of valves in a manner well known in the art. Accordingly, the amount of tension applied to the elastic band may be predetermined and adjusted.

Figure 4:
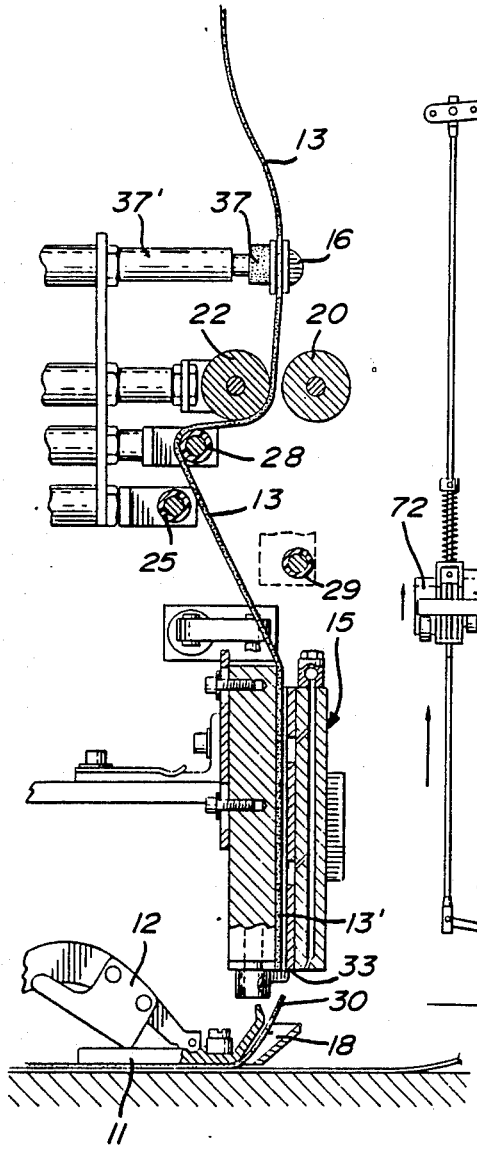

There are two idler rolls 28 and 29 positioned on each side of the band stretching idler roll 25 and adjacent the elastic band 13 and disposed on the common side of the band to guide the band when the stretching idler roll is at a stretching position, as shown in FIG. 3. The guide idler roll 28 also constitutes a band storage roll which is displaceable to a retracted position as shown in FIG. 4 to pull on the elastic band prior to being severed, such as shown at 30, whereby to pull a predetermined length of elastic band from the feed roll (not shown), and store same in an area between the tension guide jaws 16 and the guide tunnel 15. The elastic band 13 is then clamped in the jaws 16 by the piston head 37 (see FIG. 4) prior to being severed. The length of band 13 stored in the longer travel path is sufficient to position a leading portion of the band under the sewing guide member 11, when lifted.

The guide tunnel device 15 is provided with an adjustment screw 31 to adjust the dimension of the orifice through which the elastic band passes for maintaining the elastic band in planar alignment. The screws 31' secure a moving wall (not shown) after the adjustment is made. A scissor element 32 constitutes a cutting means, and it is secured adjacent a lower flat surface 33 of the guide tunnel 15 and moveable across a band at the exit orifice.

A guide air nozzle 35 and intermediate nozzles, 106 communicate with an air passage 105 and the tunnel 107, and constitutes a feed means of the elastic band through the guide tunnel 107 of the device 15 for directing the elastic leading portion in the direction of the jaw opening 18 of the sewing guide member 11, and as indicated by arrow 36, and under the member 11, which is lifted. The machine is now ready to start another stitching cycle. In this position the jaw plate piston head 37 is retracted from jaw plate 16''. Accordingly, a predetermined end portion 13' of the elastic band 13 can be directed into the jaw opening 18 and under the sewing guide 11 to a precise position determined by the length of band pulled by the cylinder 28' which also has an adjustable stroke.

Figure 6:
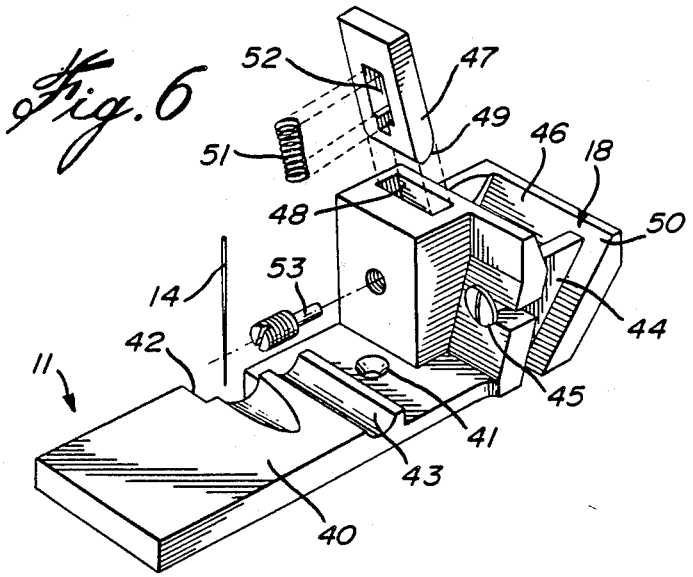
FIG. 6 is a perspective exploded view showing the construction of the sewing guide member.
Figure 7:
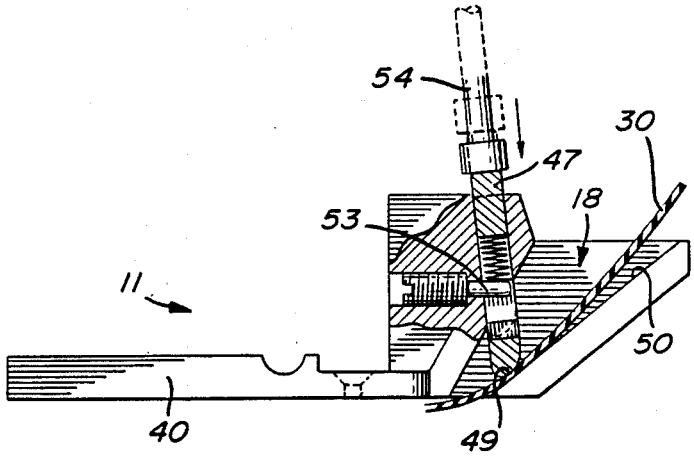
FIG. 7 is a side view, partly fragmented, of the sewing guide member of FIG. 6.

Referring now to FIGS. 6 and 7, there will be described the construction of the sewing guide member 11. As herein shown, the sewing guide 11 comprises an attachment plate 40 having a screw bore 41 therein for attaching the plate to the foot arm 12 of the sewing machine. A single screw is all that is necessary to provide this attachment, and accordingly the sewing guide 11 is easily attachable and removable from the foot arm 12 of the sewing machine when it is necessary not to utilize the feeding and tensioning mechanism of the present invention. A slot 42 is provided in the attachment plate 40 to accomodate the looper (not shown) of the sewing machine. A holding notch 43 is associated with the foot arm 12 where downward pressure is applied.

As herein shown, the jaw opening 18 is provided with an adjustable guide block 44 which is adjustable laterally by the adjustment screw 45 whereby to accomodate elastic bands of different widths by varying the dimension of the guide passage 46 therein. The sewing guide 11 is further provided with a friction shoe 47 to apply a retention force on a trailing cut end portion 30 of the elastic band 13 which is still being sewn after the scissor element 32 has severed the elastic band. This friction plate is guided in a slot 48 and as a rounded friction end 49 for contact with the elastic band to frictionally retain the band against the guide wall 50 of the jaw opening 18. The friction plate 47 is spring-biased by means of a coil spring 51 disposed in a spring cavity 52 and resting against an abutment screw 53 whereby to bias the friction plate in a direction away from the guide wall 50. An air pressure hose 54 is connected to the top end of the friction shoe and displaces the show inwardly towards the guide wall 50 against the pressure of the spring 51 to apply a friction retaining force to the cut trailing end portion 30 of the elastic band to continue the stitching operation. The amount of retention force applied to the friction shoe 47 may be controlled by the air pressure to maintain a certain tension in the end portion of the elastic band proportional to the tension in the band portion already sewn.

It is further pointed out that with the guide means of the present invention including the guide block 44 the elastic band is maintained in alignment practically throughout the entire stitching operation, and accordingly when an elastic band is stitched circumferentially about a garment, the ends of the elastic band are substantially perfectly overlapped and stitched in this position thereby providing a smooth inside finish on the garment, unlike with many of the prior art devices where the end portions are angulated from one another and often unstitched thus causing irritation to the wearer's skin.

Referring now to FIGS. 1, 5, 8, 9 and 10, there is shown the construction of a fabric puller mechanism 60 which is associated with the elastic band feeding and tensioning mechanism 10 of the present invention. The puller mechanism 60 comprises a rotatable friction engaging feed wheel 61 which is rotatably driven by a drive belt 64 supported between a drive wheel 63 and a driven wheel 62 in a displaceable linkage or frame 65. The shaft 62' of the driven wheel 62 is connected to the feed wheel 61. The drive wheel 63 is connected to a drive shaft 63' which, as shown in FIG. 1, is connected to drive the main drive shaft 21 through a drive coupler 66 comprising a pair of coupling gears 7 and drive belt 68 disposed about a drive wheel 68' and a driven wheel 68''. This drive coupler has a ratio of 2:1 and ensures that the feed wheel 61 is driven at twice the speed as the main drive shaft 21. It is pointed out that the fabric puller mechanism is utilized when a second elastic band 13 is applied to a fabric and its purpose is to provide a means to advance the fabric and to permit to stretch the already sewn elastic band and gathered fabric whereby the already stitched elastic band can be pulled back to its initial stretched position to have substantially uniform gathering across both elastic bands. This is done by the operator pulling on the fabric portion being fed under the fed wheel 61 whereby to unstretch the elastic band. Accordingly, there may be provided a fabric having a pair of elastic bands positioned side by side and stitched in a stretched manner whereby when released provides uniform transverse gathering in the fabric portion and across both elastic bands. This is particularly useful when making suspenders, belts, or other elements requiring double pleated or gathered bands of fabric.

Figure 9:
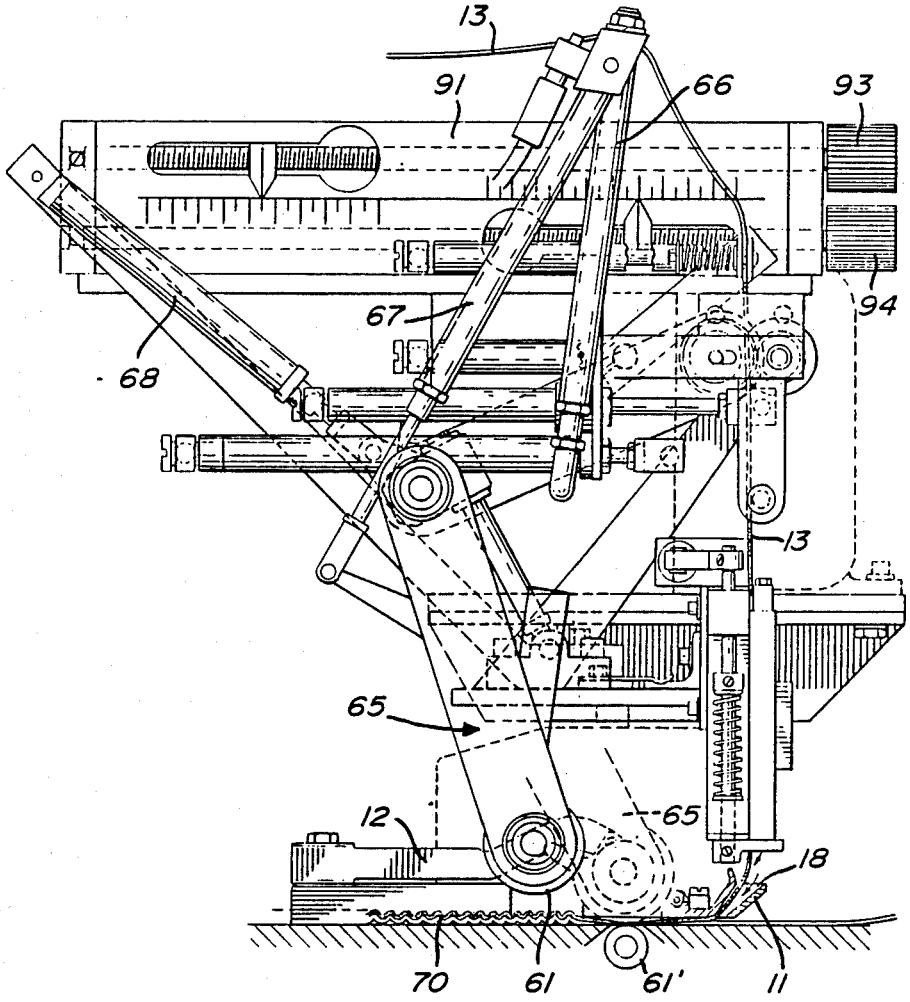
Figure 10:
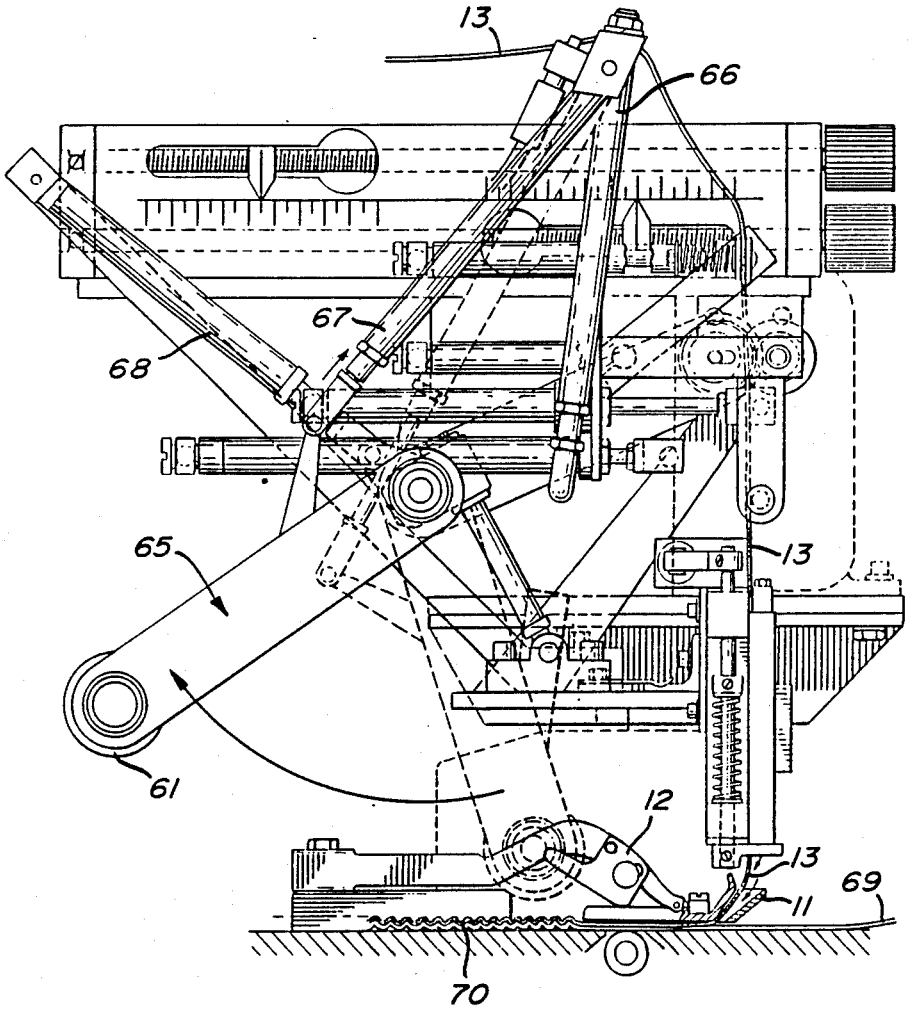

As herein shown the displaceable linkage 65 is connected to a pressure applying cylinder 66 to apply downward pressure on the friction engaging drive wheel 61 which is positioned adjacent a cushion roll 61' in the sewing surfaces whereby to apply retention pressure on the fabric 69 against the pulling force on the fabric exerted in the opposite direction to that of the feed by the operator, as above described. The displaceable linkage 65 is further connected to a retracting cylinder 67 and a lifting cylinder 68 to disengage the friction engaging feed element or wheel 61 from the fabric piece 69, and to position the puller mechanism 62 to a storage position. FIG. 9 illustrates the puller mechanism in a retracted position during a stitching operation where it is not necessary to gather the material, such as at 70. FIG. 10 illustrates the puller mechanism 65 in its storage position.

Figure 11:
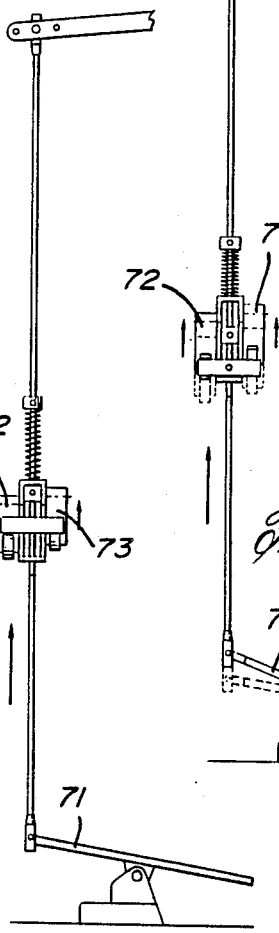
FIGS. 11 and 12 are schematic side views showing the connection of the foot control pedal with respect to the control valves of the pneumatic system.
Figure 12:
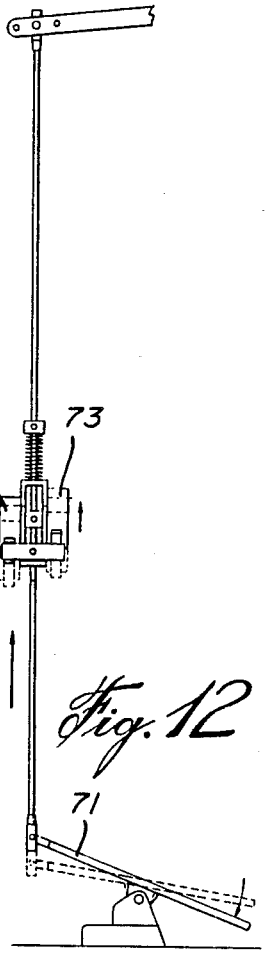
Figure 5:
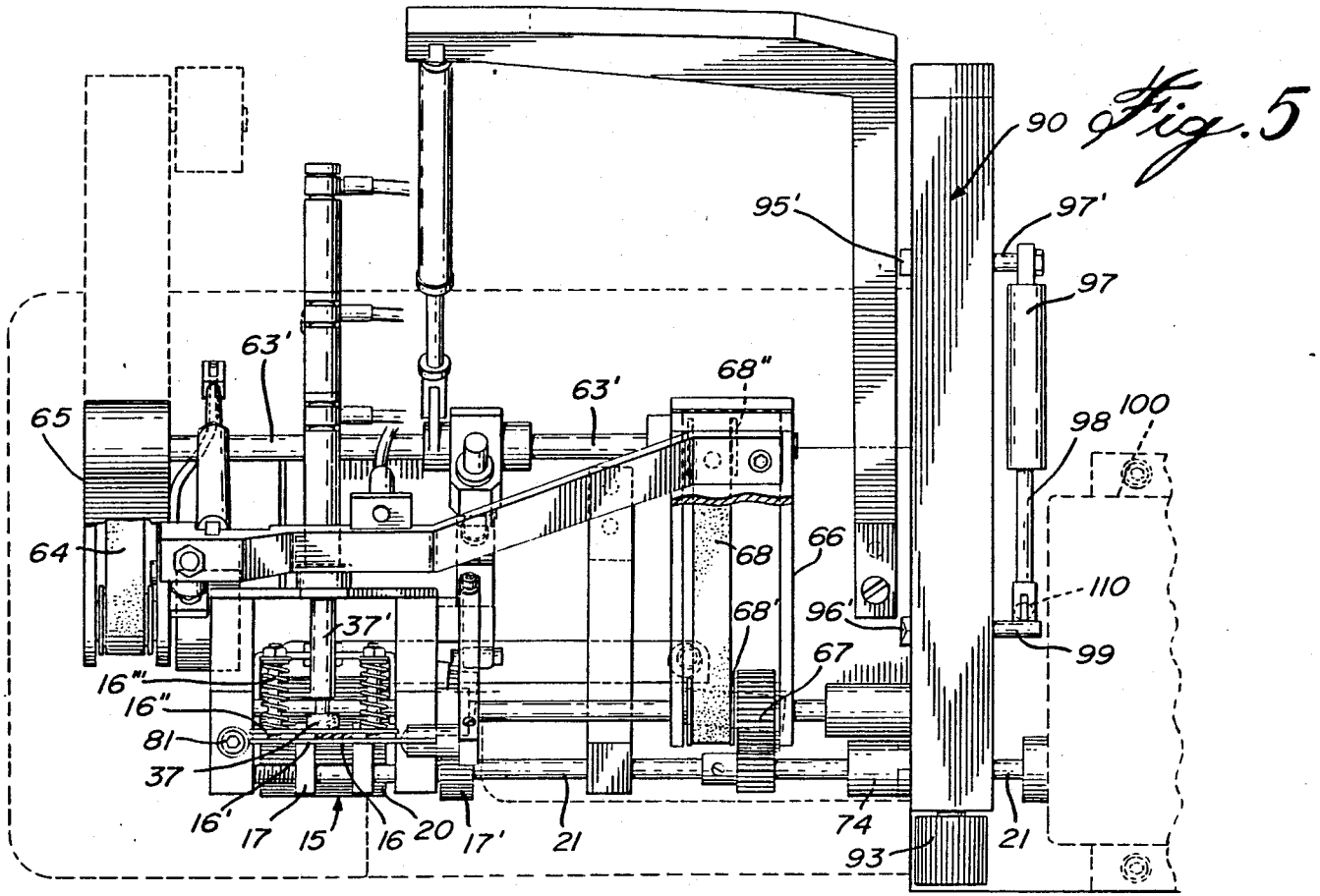
FIG. 5 is a top view of FIG. 1.

Referring now to FIGS. 11 and 12 there is schematically illustrated the construction of a foot control pedal 71 which is associated with a pair of valves 72 and 73 to actuate selected ones of pistons whereby to effect the distribution or storage of the elastic and the reintroduction of the elastic band into the jaw opening of the footplate guide, as previously described and further to start the stitching needle. The interconnection of various valves to a pneumatic supply line whereby to actuate various pistons in sequence or to control the stroke thereof will not be described herein and becomes obvious after a person skilled in the art understands the construction operation of the apparatus decribed herein. Accordingly, such pneumatic control system with valve and piston connections will not be described.

Referring now to FIGS. 13 and 14, there is shown a pivotal support frame 75 on which at least the guide tunnel device is secured whereby to displace the frame 75 to a storage position away from the stitching needle 14 whereby to utilize the sewing machine for ordinary use. However, before displacing the mechanism, the drive shaft 21 is uncoupled by simply disconnecting the spring-biased drive coupling element 74 (see FIG. 1) which is in toothed engagement. The support frame 75 is also secured by eccentric connections 76 which also provide adjustable displacement of the guide tunnel device 15 in any direction for proper fine alignment thereof with the jaw opening 18 of the sewing guide member 11. The pivotal support frame is displaceable to a storage position, as shown in phantom lines at 77, and displaceable in the direction of arrow 78 to be clear from the sewing needle of the machine. This displacement can be done manually or by means of a piston (not shown).

As further shown in FIGS. 13 and 14, the scissor element 32 is activated by a cutter cylinder 79 which is connected to a linkage 80 which rotates a cutter shaft 81 to which is connected the scissor 32 through a torsion coil spring 82. By rotating the shaft 81 torsion is applied to the spring which in turn causes the scissor element 32 to effect a fast displacement stroke against the orifice 34 in the lower face 33 of the guide tunnel device 15. The cutter cylinder 79 is operated through a push button valve (not shown) controlled by the operator.

Figure 8:
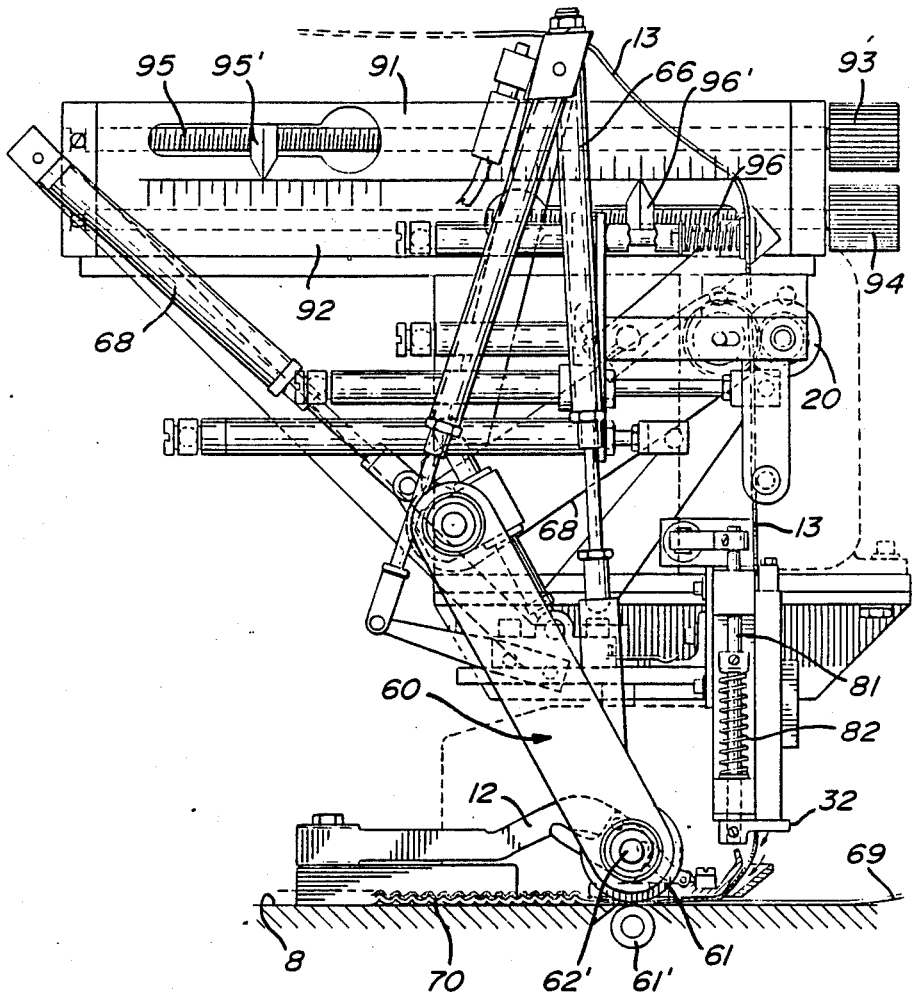
FIGS. 8, 9 and 10 are side views showing the construction of the puller mechanism with respect to the feeding and tensioning mechanism.

Referring again to FIGS. 1, 5, 8, and 15 and 16, there will be described the construction of a speed control device 90 which consists essentially of two variable speed control adjusting elements 91 and 92. The device 92 is adjusted to control the speed of the drive tension roll 20, and as previously described this roll is driven slower than the feeddog speed whereby to stretch the elastic band. As shown in FIGS. 1 and 8, this is accomplished by positioning a stopper pin 99 which is secured to a threaded block (not shown) displaceable on threaded rod 96. An indicator 96' and grid 96'' provide for fine adjustment of the position of the pin 99. The pin 99 limits the forward stroke of the piston rod 98 of piston 97. The piston rod 98 is connected to a speed control arm 110 of a speed control box 100. The forward stroke reduces the speed of the drive 100 and then the low speed position of the arm 110 can be fixed for the desired low speed of the drive tension roll 20. The position of the pin 99 is adjusted by the knob 94 connected to the threaded shaft 96.

The other control 91 is constructed similarly and its threaded shaft 95 has a displaceable block (not shown) and indicator 95′ connected to a pin 97′ to position the cylinder 97 at a desired position along an axis to vary the position of the speed control arm 110 in the retracted piston rod stroke which is the maximum speed desired by the speed control box 100. This maximum speed is adjusted to drive the puller wheel 61 at a desired speed depending on the speed of the sewing machine at the time of stitching the first elastic band to the garment.

FIG. 15 shows the position of the piston rod 98 extended for low speed drive of the tension drive roll 20 corresponding to the position of the mechanism of FIG. 3. FIG. 16 shows the position of the piston rod 98 retracted for high speed drive, no tension being applied to the elastic band. This corresponds to the position of the mechanism as shown in FIG. 2.

Referring now specifically to FIGS. 1 to 4, there will be described the operation of the present invention. As herein shown the elastic band 13 is fed through a pair of tention guide jaws 16 where a slight friction force is applied to maintain the elastic band taut against the pulling force of the feeddog 9. When no tension is required on the elastic band the apparatus is in the position as shown in FIG. 2 with the idler pressure rod 22 retracted. Accordingly, elastic band is sewn on the fabric piece 69 and the output of the stitching needle is, as shown in FIG. 2, a flat fabric piece having a flat elastic band sewn thereon. When it is necessary to provide a gathered portion of the fabric, as shown in FIG. 3 and as identified by reference numeral 70, the drive roll 20 is operated at a predetermined adjusted feed speed which is inferior to the pulling speed of the feeddog 9. Simultaneously the piston rod 26 to which is connected the elastic band stretching idler roll 25 is advanced in the direction of arrow 27 to further stretch the elastic band 13. The amount of stretching in the elastic band is controlled by the speed of rotation of the drive roll 20. After a predetermined amount of stretched elastic band has been sewn onto the fabric piece 69, the operator will effect a cutting stroke by pressing on the foot control pedal 71. This will cause the cylinder 24 to retract the idler roll 22 and to also cause the cylinder 28′ to retract the storage roll 28 and pull a stored length of elastic band. The cylinder 37′ is then operated to push its piston rod head 37 against the clamping plate 16″ to clamp the band 13. The piston 79 then operates to activate the cutting blade 32 to sever the elastic band.

In order to rethread the cut end portion 13′ of the elastic band back into the throat opening of the footplate guide 11, the air supply to the nozzles 35 and 106 is actuated and the storage idler roll 28 is returned to its initial position, as shown in FIG. 2, whereby the severed end portion 13′ of the elastic band is directed into the mouth opening 18 and under the sewing guide member 11 which has lifted. As shown in FIG. 2, the air passage 105 is provided with intermediate orifices 106 which directs air into openings 107 adjacent the elastic band 13 in the tunnel 15′ whereby to push the elastic band downwardly sufficient to pull all the slack or stored portion of the elastic band below the tension guide jaws 16 which are closed. By starting the machine the guide member 11 moves down and the feeddog will advance the fabric piece 69 and the free end portion of the elastic 13′ thereunder for effecting a stitching operation. The piston head 37 is also retracted. The jet 35 merely guides the free end portion of the elastic band into the jaw plate.

If it is desired to sew two elastic bands side by side and to impart tension to the band to provide gathering, the puller mechanism 65 is then brought down to bear against the already sewn elastic band and effect its function as described in detail above.

It is pointed out that the present band feeding and tensioning mechanism is not restricted for the feeding and tensioning elastic band and that other type bands may also be utilized with the invention.

It is within the ambit of the present invention to cover any obvious modifications of the example of the preferred embodiment described herein, provided such modifications fall within the scope of the appended claims.

I claim:

1. A band feeding and tensioning mechanism for use with a sewing machine, said mechanism comprising a sewing guide member for positioning an elongated flat band in alignment on a fabric piece, said sewing guide member being adapted for securement to a foot arm of a sewing machine and having a jaw opening for receiving said elongated flat band, guide means for guiding said elongated flat band toward said jaw opening, drive means associated with said sewing machine for advancing said elongated flat band through said guide means, tension means for tensioning said elongated flat band, said tension means including a tension drive roll and drive idler engageable with said tension drive roll for feeding said elastic band at a predetermined speed slower than said drive means, and a band stretching means for instantaneously stretching said elastic band between said tension drive roll and said drive means, and cutting means to cut said elongated flat band in an area prior to entering said jaw opening of said sewing guide member.

2. A band feeding and tensioning mechanism as claimed in claim 1, wherein said band is an elastic band.

3. An elastic band feeding and tensioning mechanism as claimed in claim 2, wherein said elongated flat band is an elastic band and wherein there is further provided control means for activating said tension means for feding a predetermined length of said elastic band in a predetermined stretched condition through said foot plate guide for sewing said stretched elastic band on a fabric piece.

4. An elastic band feeding and tensioning mechanism as claimed in claim 3, wherein there is further provided storage means for storing a predetermined length of said elastic band in an unstretched condition prior to said cutting means being activated.

5. An elastic band feeding and tensioning mechanism as claimed in claim 4, wherein there is further provided feed means for feeding a stored free end portion of said elastic band in said jaw opening of said sewing guide member.

6. An elastic band feeding and tensioning mechanism as claimed in claim 5, wherein said guide means comprises a guide tunnel device positioned above said jaw opening of said foot plate guide for maintaining said elastic band in planar alignment, and tension guide jaws positioned spaced above said guide tunnel for friction sliding fit with said elastic band.

7. An elastic band feeding and tensioning mechanism as claimed in claim 6, wherein said tension drive roll is connected to a drive shaft, said drive idler roll and drive roll being positioned intermediate said guide tunnel and said tension guide jaws.

8. An elastic band feeding and tensioning mechanism as claimed in claim 7, wherein said drive idler roll is supported on a displaceable piston rod to move said idler roll toward and away from said tension drive roll to disengage said elastic band from said drive roll.

9. An elastic band feeding and tensioning mechanism as claimed in claim 7, wherein said drive means is constituted by a feeddog of a sewing machine, said feeddog pulling said elastic band through said sewing guide member, said elastic band being stretched by controlling the speed of rotation of said drive shaft of said drive roll in relation to the pulling speed of said feeddog, said rotation speed of said drive roll being slower than said feeddog to stretch said elastic band.

10. An elastic band feeding and tensioning mechanism as claimed in claim 7, wherein said band stretching means is a band stretching idler roll displaceable to engage said elastic band intermediate said drive roll and guide tunnel and to displace said band out of a straight plane to instantaneously stretch said band.

11. An elastic band feeding and tensioning mechanism as claimed in claim 10, wherein said control means is constituted by a pneumatic system which controls a piston connected to said stretching idler roll to displace said roll from a band stretching position to a band release position.

12. An elastic band feeding and tensioning mechanism as claimed in claim 10, wherein said cutting means comprises a scissor element secured adjacent a lower flat face of said guide tunnel and movable across a band exit orifice in said lower flat face whereby to sever said elastic band at said exit orifice.

13. An elastic band feeding and tensioning mechanism as claimed in claim 9, wherein said feed means comprises air nozzles disposed adjacent said elastic band in said guide tunnel and adjacent an exit orifice in a lower face of said guide tunel for directing air jets in the direction of said jaw opening of said foot plate guide to direct a free end portion of said elastic band to exit from said exit orifice and into said jaw opening and under said sewing guide member when lifted.

14. An elastic band feeding and tensioning mechanism as claimed in claim 10, wherein said storage means is constituted by a storage idler roll displaceable across the longitudinal axis of said elastic band to displace said band when in an unstretched condition and pull a predetermined length of elastic band from a storage area to an area between said tension guide jaw and said guide tunnel.

15. An elastic band feeding and tensioning mechanism as claimed in claim 10, wherein said guide tunnel is provided with an adjustable guide wall to adjust the dimension of a tunnel passage depending on the width of said elastic band.

16. An elastic band feeding and tensioning mechanism as claimed in claim 10, wherein said tension guide jaws comprise a, pair of jaw plates through which said elastic band is displaced, said jaw plates applying friction to said elastic band, and pressure applying means to cause said jaw plates to clamp said elastic band prior to activation of said cutting means.

17. An elastic band feeding and tensioning mechanism as claimed in claim 16, wherein said pressure applying means is a piston rod end movable to press said jaw plates closer together.

18. An elastic band feeding and tensioning mechanism as claimed in claim 10, wherein a guide idler roll is provided on each side of said band stretching idler roll and adjacent said elastic band on a common side thereof to guite said band when said stretching idler roll is at a stretching position.

19. An elastic band feeding and tensioning mechanism as claimed in claim 18, wherein one of said guide idler displaceable to constitute said storage means.

20. An elastic band feeding and tensioning mechanism as claimed in claim 11, wherein said pneumatic system further controls other pistons connected to said drive idler roll, said tension guide jaws, a storage idler roll, said band stretching idler roll and a scissor element of said cutting means, all of said pistons being synchronized to effect an elastic band feeding, stretching, cutting and storage pulling cycles.

21. An elastic band feeding and tensioning mechanism as claimed in claim 20, wherein there is further provided a foot control pedal associated with a pair of valves to actuate selected ones of said pistons to effect some of said cycles.

22. An elastic band feeding and tensioning mechanism as claimed in claim 3, wherein said sewing guide member is further provided with an adjustable guide block in said jaw opening to vary the width dimension of a guide passage in said jaw opening depend on the width dimension of said elastic band.

23. An elastic band feeding and tensioning mechansm as claimed in claim 22, wherein said sewing guide member is further provided with a friction shoe to apply a retention force on a cut trailing end portion of said elastic band being sewn after said cutting means has been actuated to sever said band.

24. An elastic band feeding and tensioning mechanism as claimed in claim 23 wherein said friction shoe is a friction plate guided in a slot in said sewing guide member and having a friction end for contact with said band to frictionally retain said band against a guide wall of said jaw opening, said friction plate being spring-biased in a direction away from said guide wall by a spring force, and air pressure means to displace said friction plate in the direction of said guide wall and against said spring force.

25. An elastic band feeding and tensioning mechanism as claimed in claim 9, wherein said drive shaft is connected to a speed control device having a pair of speed control elements, a control cylinder having an adjustable stroke controlled by a first of said speed control elements whereby to adjust the maximum speed of rotation of said drive shaft, a second of said speed control elements limiting the forward stroke of said piston to adjust the minimum speed of rotation of said drive shaft.

26. An elastic band feeding and tensioning mechanism as claimed in claim 25, wherein said control cylinder is connected to a displaceable block on a threaded shaft which constitutes said first speed control, and a stop pin secured to a block on a second threaded shaft and constituting said second speed control, a means to rotate each said shaft to position said blocks at predetermined positions.

27. An elastic band feeding and tensioning mechanism as claimed in claim 7, wherein there is further provided a guide member disposed between said drive roll and tension guide jaws and displaceable laterally with respect to the longitudinal axis of said elastic band whereby to displace said band laterally for proper alignment thereof with said guide tunnel.

28. An elastic band feeding and tensioning mechanism as claimed in claim 7, wherein at least said guide tunnel device is secured to a pivotal support frame which is displaceable from an elastic band feeding position to a storage position away from said sewing guide member.

29. An elastic band feeding and tensioning mechanism as claimed in claim 28, wherein said pivotal support frame is secured by an eccentric connection to adjustably displace said guide tunnel for proper alignment with said jaw opening of said sewing guide member.

30. An elastic band feeding and tensioning mechanism as claimed in claim 10, wherein there is further provided a fabric puller mechanism comprising a rotatable friction engaging feed element supported on a displaceable linkage, drive means for imparting rotation to said friction engaging feed element, said friction engaging drive element being positionable adjacent said sewing guide member to engage a fabric portion having an elastic band pre-sewn thereon with at least a gathered portion caused by said pre-sewn band having been sewn under a stretched condition, said drive means advancing said fabric at substantially the same speed as said feeddog of said sewing machine.

31. An elastic band feeding and tensioning mechanism as claimed in claim 30, wherein said friction engaging feed element is a friction wheel having an outer friction surface and rotatably driven by a drive belt supported between a drive roll and a driven roll, said drive roll being coupled to said drive shaft of said drive roll through a gearing mechanism.

32. An elastic band feeding and tensioning mechanism is connected to a pressure applying cylinder to cause said friction engaging feed element to apply retention pressure on said fabric against a pulling force opposite to the direction of feed of said fabric and sufficient to stretch said gathered portion of said fabric and elastic to substantially its initial stretch position when initially sewn.

33. An elastic band feeding and tensioning mechanism as claimed in claim 32, wherein said displaceable linkage is further connected to a retracting and a lifting cylinder to disengage said friction engaging feed element from said fabric piece and to position same to a storage position.

34. A method of feeding and tensioning at least a portion of an elongated flat band for application on a fabric piece fed under a stitching needle of a sewing machine, said method comprising the steps of:

(i) feeding said elastic band in a sewing guide member for positioning said band over a fabric piece and under a stitching needle of a sewing machine;
(ii) pulling said band by said feeddog;
(iii) stretching said band by engaging said band-tension drive means, advancing same to said sewing guide member at a slower rate than said pulling rate of said feeddog;
(iv) instantaneously applying a predetermined instant tension to said band when said step (iii) is actuated; and
(v) severing said band at a predetermined location.

35. A method as claimed in claim 34, wherein there is further provided the steps of:

(vi) pulling a predetermined length of said band during an idle cycle to a store a predetermined length of said elastic band, and
(vii) frictionally retaining said length of said band prior to said cutting step.

36. A method as claimed in claim 35, wherein there is further provided applying a slight friction retention force to said elastic band by feeding same through tension guide jaws prior to said tension drive means.

37. A method as claimed in claim 36, wherein there is further provided the step of adjusting the alignment of said elastic band with respect to a jaw opening of said sewing guide member.

38. A method as claimed in claim 35, wherein there is further provided the step of frictionally engaging a portion of said fabric piece having a pre-sewn elastic band sewn by a friction wheel thereto, said fabric having at least a gathered portion caused by said pre-sewn band having been sewn under a stretched condition, and pulling said fabric piece to apply a retention pressure opposite to the direction of feed of said fabric and sufficient to stretch said gathered portion of said fabric and elastic to substantially its initial stretch position when initially sewn.

39. A method as claim 38, wherein there is provided the step of driving said friction wheel at substantially twice the speed as said tension drive means.

* * * * *